United States Patent [19]

Imazu et al.

[11] Patent Number: 4,962,659

[45] Date of Patent: Oct. 16, 1990

[54] REDRAWING METHOD

[75] Inventors: Katsuhiro Imazu, Yokohama; Tomomi Kobayashi, Yokohama; Masao Ishinabe, Atsugi; Hisao Iwamoto, Yokohama, all of Japan

[73] Assignee: Toyo Seikan Kaisha, Ltd., Tokyo, Japan

[21] Appl. No.: 313,843

[22] Filed: Feb. 23, 1989

[30] Foreign Application Priority Data

Feb. 23, 1988 [JP] Japan ..... 63-38579

[51] Int. Cl.[5] ..... B21D 22/20

[52] U.S. Cl. ..... 72/349

[58] Field of Search ..... 72/349, 350, 347

[56] References Cited

U.S. PATENT DOCUMENTS

| | | | |
|---|---|---|---|
| 4,412,440 | 11/1983 | Phalin et al. | 72/46 |
| 4,425,778 | 1/1984 | Franek | 72/349 |
| 4,485,663 | 12/1984 | Gold et al. | 72/349 |
| 4,522,049 | 6/1985 | Clowes | 72/349 |

FOREIGN PATENT DOCUMENTS

| | | | |
|---|---|---|---|
| 199079 | 7/1967 | U.S.S.R. | 72/347 |

OTHER PUBLICATIONS

U. K. Patent Application No. 2,103,134 A, pub. Feb. 16, 1983, Inventor–Thomas Phalin, Classified in Class 72, Sub. 349.

"Design for Drawing Aluminum", Modern Metals, pub. in Oct. 1962; by J. W. Lengbridge; Classified in 72/347.

WO 86/05421, (PCT), pub. Sep. 25, 1986; Inventor: Saunders, W. T.; Classified in Class 72, sub. 349.

*Primary Examiner*—Robert L. Spruill

*Attorney, Agent, or Firm*—Sughrue, Mion, Zinn, Macpeak & Seas

[57] ABSTRACT

The present invention provides a redrawing method which comprises holding a preliminarily drawn cup of a covered metal sheet by an annular holding member inserted in the cup and a redrawing die, and relatively moving the redrawing die and a redrawing punch arranged coaxially with the holding member and redrawing cup, the drawing punch being capable of going into the holding member and coming out from the holding member, so that the redrawing die and redrawing punch are engaged with each other, to form a deep-drawn cup having a diameter smaller than that of the preliminarily drawn cup. This redrawing method is prominently characterized in that the radius of curvature of the operating corner portion of the redrawing die is 1 to 2.9 times as large as the bare sheet thickness of the metal sheet. According to this redrawing method, the thickness is effectively reduced by bending anad elongating of the side wall, and the variation of the thickness between the upper and lower portions of the side wall is eliminated and the thickness is uniformly reduced as a whole.

14 Claims, 3 Drawing Sheets

Fig. 1
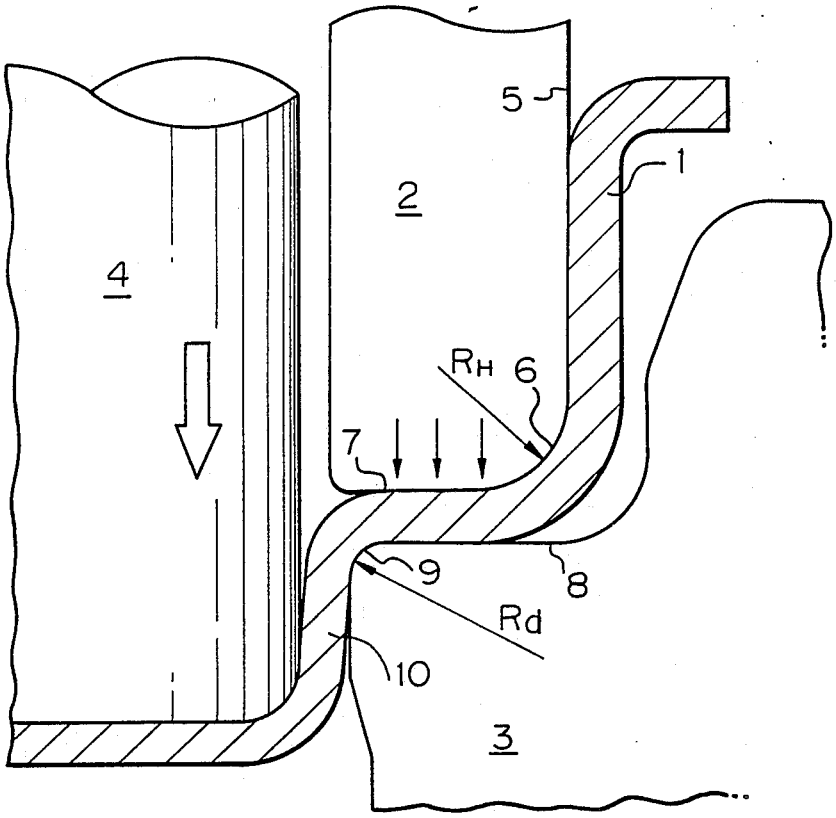
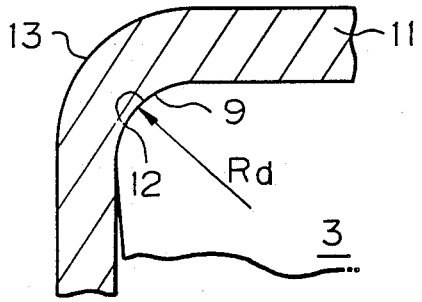
Fig. 2

REDRAWING METHOD

Background of the Invention (1) Field of the Invention

The present invention relates to a redrawing method. More particularly, the present invention relates to a method in which the thickness of a preliminarily drawn cup of a covered metal sheet is uniformly reduced by bending and elongating a side wall portion of a can barrel while drastically reducing the damage of a covering layer.

(2) Description of the Prior Art

The production of a seamless can barrel by subjecting a covered metal sheet to drawing and redrawing has been carried out from old in the can-manufacturing industry. At this drawing-redrawing forming, the metal is caused to make such a plastic flow that the size increases in the height direction of the can but the size decreases in the circumferential direction of the can barrel. Accordingly, in the can barrel obtained by the drawing-redrawing forming, the thickness of the side wall of the can barrel increases toward the upper portion from the lower portion, and the thickness is extremely large at the upper end (open end) of the side wall.

It also is known that at the drawing-redrawing forming, a deep-drawn cup having a small diameter is formed at a curvature corner part of a redrawing die and the side wall portion is bent and elongated to reduce the thickness of the side wall portion. In this case, the thickness of the side wall portion as a whole is reduced, but the upper portion is influenced by compression in the circumferential direction and the thickness of the upper portion tends to increase.

As the means for eliminating this disadvantage, Japanese Patent Application Laid-Open Specification No. 501442/81 proposes a method in which the side wall portion is bent and elongated at a curvature corner part of a redrawing die and then, the side wall portion is ironed at a front die stroke part, whereby the thickness of the side wall portion is uniformalized throughout the height direction of the can.

According to this conventional method, since the upper portion of the side wall where the thickness is increased by compression in the circumferential direction is ironed, the thickness of the entire side wall portion is uniformalized, but since the compression stress and ironing force are applied to the upper portion of the side wall, the covering resin layer is considerably damaged or the adhesion of the covering resin layer to the metal sheet tends to decrease. Therefore, in a final canned product, such a problem as corrosion or erosion of the metal arises, and a swollen can is formed by generation of hydrogen or a leak can is formed by pitting.

Summary of the Invention

It is therefore a primary object of the present invention to provide a method in which a drawn-redrawn can having a uniform small thickness in a side wall portion of a can barrel is prepared from a preliminarily drawn cup by bending and elongating the side wall portion while drastically reducing the damage of a covering layer.

Another object of the present invention is to provide a method in which a drawn-redrawn can having a uniform small thickness throughout a side wall portion of a can barrel and having an excellent corrosion resistance is formed from a covered metal sheet.

More specifically, in accordance with one aspect of the present invention, there is provided a redrawing method which comprises holding a preliminarily drawn cup of a covered metal sheet by an annular holding member inserted in the cup and a redrawing die, and relatively moving the redrawing die and a redrawing punch arranged coaxially with the holding member and redrawing die, said drawing punch being capable of going into the holding member and coming out from the holding member, so that the redrawing die and redrawing punch are engaged with each other, to form a deep-drawn cup having a diameter smaller than that of the preliminarily drawn cup, wherein the radius ($R_D$) of curvature at an operating corner part of the redrawing die is 1 to 2.9 times as large as the bare sheet thickness ($t_B$) of the metal sheet, the radius ($R_H$) of curvature of the holding corner part of the holding member is 4.1 to 12 times as large as the bare sheet thickness ($t_B$) of the metal sheet, flat engaging portions of the holding member and redrawing die with the preliminarily drawn cup have a dynamic friction coefficient of 0.001 to 0.2, and redraw forming is carried out in at least one stage so that the redraw ratio defined as the ratio of the diameter of the shallow-drawn cup to the diameter of the deep-drawn cup is in the range of from 1.1 to 1.5, wherein the entire side wall portion of the cup is bent uniformly in the direction of the height.

In accordance with another aspect of the present invention, there is provided a drawn-redrawn can formed of a covered metal sheet, wherein the entire draw ratio is in the range of from 2.0 to 4.0, the side wall portion is thinned to a thickness corresponding to 60 to 95% of the bare sheet thickness on the average, the ratio of the thickness of the upper portion of the side wall to the thickness of the lower portion of the side wall is less than 1.5, and the drawn-redrawn can has such a covering completeness that the enamel rater value (mA) of the upper portion of the side wall is smaller than 5 times the enamel rater value (mA) of the lower portion of the side wall.

Brief Description of the Drawings

FIG. 1 is a sectional view illustrating the redrawing method of the present invention.

FIG. 2 is a sectional view illustrating the principle of bending and elongating.

Detailed Description of the Invention

Figure 3:
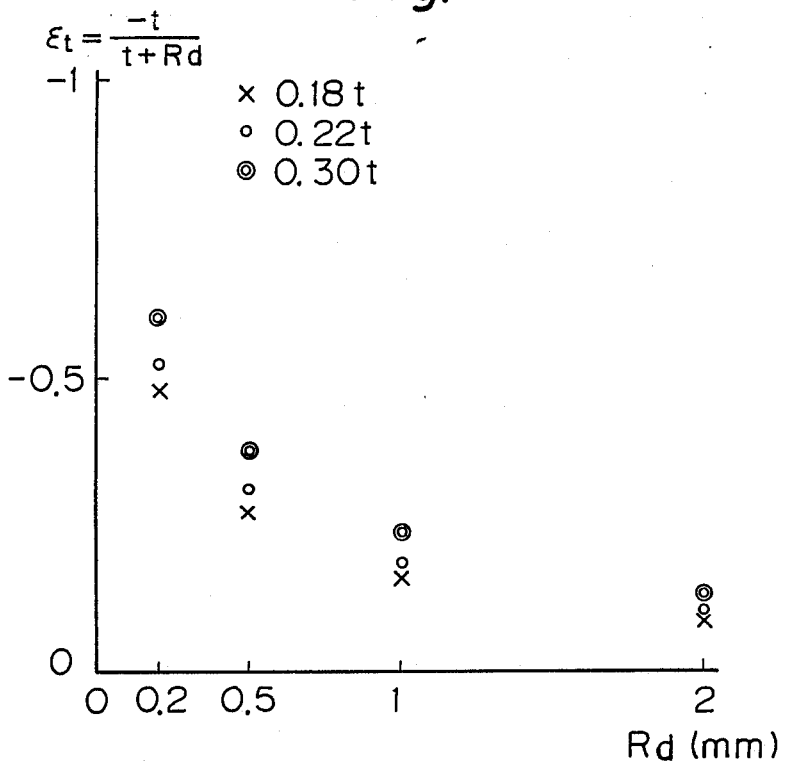
FIG. 3 is a diagram illustrating the relation between the radius $R_D$ of curvature of the operating corner and the thickness change ratio $\epsilon t$.

Referring to FIG. 1 illustrating the redrawing method of the present invention, a preliminarily drawn cup 1 formed of a covered metal sheet is held by an annular holding member 2 inserted into the cup and a redrawing die 3 located below the holding member 2. A redrawing punch 4 is arranged coaxially with the holding member 2 and redrawing die 3 so that the redrawing punch 4 can go into the holding member 2 and come out therefrom. The redrawing punch 4 and redrawing die 3 are relatively moved so that they are engaged with each other.

By this arrangement, the side wall portion of the preliminarily drawn cup 1 is introduced from a peripheral face 5 of the annular holding member 2 and is passed through a curvature corner part 6 of the holding member 2, whereby the side wall portion is bent vertically inwardly in the radial direction, and the side wall portion is passed through a region defined by an annular bottom face 7 of the annular holding member 2 and an upper face 8 of the redrawing die 3 and the side wall portion is bent substantially vertically to the axial direction by an operating corner portion 9 of the redrawing die 3, whereby a deep-drawn cup having a diameter smaller than that of the preliminarily drawn cup 1 and the thickness of the side wall portion is reduced by bending and elongating.

The present invention is based on the finding that if the radius ($R_D$) of curvature of the operating corner portion 9 of the redrawing die is adjusted to a value 1 to 2.9 times, especially 1.5 to 2.9 times, as large as the bare thickness ($t_B$) of the metal sheet, reduction of the thickness of the side wall portion by bending and elongating can be effectively accomplished, and furthermore, the difference of the thickness between the lower and upper portions of the side wall can be eliminated and the thickness can be uniformly reduced throughout the side wall. This point will now be described.

Referring to FIG. 2 illustrating the principle of bending and elongating, a covered metal sheet 11 is forcibly bent under a sufficient back tension along the operating corner portion 9 having the radius $R_D$ of curvature. A strain is not generated in a surface 12 of the covered metal sheet 11 on the side of the operating corner portion, but a strain is generated in a surface 13 on the side opposite to the operating corner portion. The quantity $\epsilon s$ of this strain is expressed by the following formula:

$$\epsilon s = \frac{2\pi(R_D + t) - 2\pi R_D}{2\pi R_D} = \frac{t}{R_D} \quad (1)$$

wherein $R_D$ stands for the radius of curvature of the operating corner portion and t stands for the sheet thickness. The surface (inner surface) 13 of the covered metal sheet is elongated by $\epsilon s$ at the operating corner portion, but the other surface (outer surface) 12 is elongated by the same quantity as $\epsilon s$ by the back tension just below the operating corner portion. If the covered metal sheet is thus bent and elongated, the thickness is reduced. The change ratio $\epsilon t$ of the thickness is given by the following formula:

$$\epsilon t = \frac{-t}{R_D + t} \quad (2)$$

From the above formula (2), it is seen that reduction of the radius $R_D$ of curvature of the operating corner portion 9 is effective for reducing the thickness of the covered metal sheet, that is, the smaller is $R_D$, the larger is the thickness change $|\epsilon t|$. Furthermore, it is seen that if the radius $R_D$ of curvature of the operating corner portion 9 is constant, the larger is the thickness t of the covered metal sheet 11 passing through the operating corner portion 9, the larger is the thickness change $|\epsilon t|$.

FIG. 3 is a graph illustrating the relation between the radius $R_D$ of curvature of the operating corner portion 9 and the thickness change ratio $\epsilon t$ of the covered metal sheet, in which the radius $R_D$ of curvature is plotted on the abscissa and the thickness change ratio $\epsilon t$ is plotted on the ordinate. The results shown in FIG. 3 prove the above-mentioned fact.

Supposing that the thickness of the covered metal sheet 11 supplied to the operating corner portion 9 is $t_0$ and the thickness reduced by bending and elongating is $t_1$, this thickness $t_1$ is expressed by the following formula:

$$t_1 = t_0\left[1 - \frac{t_O}{t_O R_D}\right] \quad (3)$$

Incidentally, the thickness of the upper part of the side wall of the preliminarily drawn cup is increased over the standard thickness (bare thickness) $t_B$ because of the influence of compression in the circumferential direction, and this thickness is expressed by the following formula:

$$t_O = (1+\alpha)t_B \quad (4)$$

wherein $\alpha$ stands for the thickness index. Accordingly, in this case, the reduced thickness $t_1$ is expressed by the following formula:

$$\begin{aligned} t_1 &= (1+\alpha)t_B\left[1 - \frac{(1+\alpha)t_B}{(1+\alpha)t_B + R_D}\right] \\ &= \frac{R_D}{(1+\alpha)t_B + R_D}\cdot(1+\alpha)t_B \end{aligned} \quad (5)$$

Hereupon the ratio Ratio of $t_1$ in case of $\alpha \neq 0$ to $t_1$ in case of $\alpha = 0$ is expressed by the following formula:

$$\text{Ratio} = \frac{t_1\alpha \neq 0}{t_1\alpha = 0} = \frac{(1+\alpha)t_B + (1+\alpha)R_D}{(1+\alpha)t_B + R_D} \quad (6)$$

From the formula (6), it is understood that reduction of $R_D$ results in the function of controlling the thickness variation in the bent and elongated side wall portion to a small value. More specifically, in the case where $t_B$ is 0.18 mm and $\alpha$ is 0.1, if $R_D$ is 2 mm, Ratio is 1.091, but if $R_D$ is 0.5 mm, Ratio is 1.072. Namely, reduction of $R_D$ is effective for controlling the variation of the thickness and uniformalizing the thickness.

In other words, since the ratio of the thickness of the preliminarily drawn cup to the standard thickness ($t_B$) is $1+\alpha$, the ratio of controlling the thickness variation is given by the following formula:

$$(1+\alpha) - \text{Ratio} = \frac{\alpha(1+\alpha)t_B}{(1+\alpha)t_B + R_D} \quad (7)$$

If the value of the formula (7) is calculated in the above-mentioned example, the value is 0.009 in case of $R_D$=2 mm and is 0.020 in case of $R_D$—0.5 mm, and the effect in the latter case is about 3.2 times as high as the effect in the former case.

As is apparent from the foregoing description, the present invention is based on the finding that reduction of the radius ($R_D$) of curvature of the operating corner portion of the redrawing die is effective for uniformalizing the thickness of the side wall portion after bending and elongating. If the value of $R_D$ is too large and exceeds the above-mentioned range, not only the degree of reduction of the thickness of the side wall portion but also the uniformity of the thickness of the side wall portion is unsatisfactory. If the value of $R_D$ is too small and below the above-mentioned the sheet is often broken at the operating corner portion of the die at the redrawing forming and the objects of the present invention cannot be attained.

In the present invention, the radius ($R_H$) of curvature of the holding corner portion 6 of the holding number 2 is 4.1 to 12 times, especially 4.1 to 11 times, as large as the bare thickness ($t_B$) of the metal sheet, the flat engaging portions of the holding member 2 and redrawing die 3 with the preliminarily drawn cup have a dynamic friction coefficient ($\mu$) of 0.001 to 0.20, especially 0.001 to 0.10, and the draw forming should be carried out so that the redraw ratio defined as the diameter of the shallow-drawn cup to the diameter of the deep-drawn cup is in the range of from 1.1 to 1.5, especially from 1.15 to 1.45. These features will now be described.

In order to perform bending and elongating sufficiently at the operating corner portion 9 of the redrawing die, it is necessary that a back tension should be given so that the metal sheet should be supplied precisely along this operating corner portion while the metal sheet is being bent. This back tension is given by the sum of (1) the forming load imposed on the plane sheet of the side wall portion of the preliminarily drawn cup, (2) the substantial blank holder load and (3) the resistance load to deformation of the preliminarily drawn cup to the deep-drawn cup. Of course, the force of the sum of these loads should not be so large as causing breaking of the metal sheet and should be such that bending and elongating can be effectively accomplished, and a good balance should be maintained among these loads.

The radius $R_H$ of curvature of the holding corner portion 6 has a relation to either the above-mentioned forming load (1) or the formability. If the radius $R_H$ of curvature of the holding corner portion 6 is too small and below the above-mentioned range, breaking of the sheet or damage of the covering layer is readily caused. If the radius $R_H$ of curvature is too large and exceeds the above-mentioned range, wrinkles are readily formed. Accordingly, the redrawing forming is not satisfactorily accomplished if the radius $R_H$ of curvature is outside the above-mentioned range. On the other hand, if the radius $R_H$ of curvature is controlled within the range defined in the present invention, the redrawing forming can be smoothly accomplished while giving a sufficient back tension.

The dynamic friction coefficient ($\mu$) of the annular surface 7 of the holding member 2 and the annular surface 8 of the redrawing die 3 has a relation to the above-mentioned substantial blank holder force (2). The substantial blank holder force referred to herein means the force acting effectively for controlling wrinkles generated by shrinkage of the size of the metal sheet in the circumferential direction, and this force is expressed by the product of the force applied between the holding member and redrawing die and the dynamic friction coefficient ($\mu$) of these surfaces. If the dynamic friction coefficient ($\mu$) is too large and exceeds the above-mentioned range, necking breaking is often caused, and if the dynamic friction coefficient ($\mu$) is too small and below the above-mentioned range, control of formation of wrinkles becomes impossible. On the other hand, if the dynamic friction coefficient ($\mu$) is adjusted within the above-mentioned range, a back tension necessary for bending and elongating can be given while controlling formation of wrinkles or occurrence of breaking of the sheet. The redraw ratio defined as the ratio of the diameter (b) of the shallow-drawn cup to the diameter (a) of the deep-drawn cup has a relation to the above-mentioned deformation resistance load (3). If this redraw ratio (b/a) is too small and below the range defined in the present invention, the object of preparing a deep-drawn vessel can hardly be attained, and it becomes difficult to give a large back tension necessary for bending and elongating. If the ratio b/a is too large and exceeds the above-mentioned range, the deformation resistance is too large and the tendency to breaking of the sheet increases. If the redraw ratio (b/a) is adjusted within the above-mentioned range, there can be given a back tension necessary for performing the deep-draw forming efficiently, preventing breaking of the sheet and attaining high bending and elongating effects.

As is apparent from the foregoing description, according to the present invention, by selecting a small value for the radius ($R_D$) of curvature of the corner portion of the redrawing die, selecting a large value for the radius ($R_H$) of curvature of the corner portion of the holding member, selecting the dynamic friction coefficients ($\mu$) of the holding member and redrawing die and the redraw ratio (b/a) within the specific ranges and combining these values integrally, reduction and uniformalization of the thickness of the side wall portion and deep-draw forming become possible. Especially, if redrawing forming is carried out in 1 to 4 stages, the thickness of the side wall portion becomes more uniform.

According to the present invention, a deep-drawn can having an entire draw ratio of from 2.0 to 4.0, especially from 2.0 to 3.5, can be obtained.

The draw ratio referred to herein is a value defined by the following formula:

$$\text{Draw ratio} = (\text{diameter of bare sheet})/(\text{diameter of deep-drawn can}) \quad (8)$$

According to the present invention, the thickness of the side wall portion of the can body can be reduced to 60 to 95%, especially 65 to 90%, of the bare sheet thickness ($t_B$) on the average, and the ratio ($t_U/t_L$) of the thickness of the upper portion of the side wall where the thickness is most readily reduced to the thickness ($t_L$) of the lower portion of the side wall is adjusted to less than 1.5, especially from 1.0 to 1.4, whereby the thickness of the side wall portion can be uniformalized without ironing of the side wall portion. Furthermore, in the drawn-redrawn can of the present invention, since the thickness of the entire side wall portion is reduced without ironing, the degree of covering is complete, and the drawn-redrawn can of the present invention is therefore characterized in that the enamel rater value (mA) of the upper portion of the side wall is less than 5 times, especially 1 to 4 times, the enamel rater value (mA) of the lower portion of the side wall.

Various surface-treated steel sheets and sheets of light metals such as aluminum can be used as the metal sheet in the present invention.

A steel sheet obtained by annealing a cold-rolled steel sheet, subjecting the annealed steel sheet to secondary cold rolling and subjecting the cold-rolled steel sheet to at least one surface treatment selected from zinc deposition, tin deposition, nickel deposition, electrolytic chromate treatment and chromate treatment can be used as the surface-treated steel sheet. As a preferred example of the surface-treated steel sheet, there can be mentioned an electrolytically chromate-treated steel sheet, especially one having 10 to 200 mg/m$^2$ of a metallic chromium layer and 1 to 50 mg/m$^2$ (as metallic chromium) of a chromium oxide layer. This surface-treated steel sheet is excellent in both of the covering adhesion and corrosion resistance. As another example of the surface-treated steel sheet, there can be mentioned a tinplate sheet having a deposited tin amount of 0.5 to 11.2 g/m$^2$. It is preferred that this tinplate sheet be subjected to a chromate treatment or a chromate/phosphate treatment so that the amount deposited of chromium is 1 to 30 mg/m$^2$. Furthermore, an aluminum-coated steel sheet formed by deposition or pressure welding of aluminum can be used.

As the light metal sheet, there can be mentioned a so-called pure aluminum sheet and an aluminum alloy sheet. An aluminum alloy sheet having excellent corrosion resistance and processability comprises 0.2 to 1.5% by weight of Mn, 0.8 to 5% by weight of Mg, 0.25 to 0.3% by weight of Zn and 0.15 to 0.25% by weight, with the balance being Al. It is preferred that the light metal be subjected to a chromate treatment or a chromate/phosphate treatment so that the amount deposited of chromium is 20 to 300 mg/m$^2$ as metallic chromium.

The bare thickness ($t_B$) of the metal sheet is changed according to the kind of the metal, the use of the final vessel and the size thereof, but it is generally preferred that the bare thickness be 0.10 to 0.50 mm. It is especially preferred that the bare thickness be 0.10 to 0.30 in case of the surface-treated steel sheet and 0.15 to 0.40 mm in case of the light metal sheet.

In the present invention, prior to the draw forming, a protective covering of a resin is formed on the metal sheet, and the present invention is advantageous in that the deep-draw forming and the uniform reduction of the thickness of the side wall portion can be accomplished without substantially damaging the protecting covering layer. This protecting covering can be formed by coating a protecting paint or laminating a thermoplastic resin film.

Optional protecting paints comprising a thermosetting resin or a thermoplastic resin can be used as the protecting paint. For example, there can be mentioned modified epoxy paints such as a phenol-epoxy paint and an amino-epoxy paint, vinyl and modified vinyl paints such as a vinyl chloride/vinyl acetate copolymer paint, a partially saponified vinyl chloride/vinyl acetate copolymer paint, a vinyl chloride/vinyl acetate/maleic anhydride copolymer paint, an epoxy-modified vinyl paint, an epoxyamino-modified vinyl paint and an epoxyphenol-modified vinyl paint, acrylic resin paints, and synthetic rubber paints such as a styrene/butadiene copolymer paint. These paints can be used singly or in the form of mixtures of two or more of them.

The paint is applied in the form of an organic solvent solution such as an enamel or a lacquer or an aqueous dispersion or solution to the metal blank by roller coating, spray coating, dip coating, electrostatic coating or electrophoretic coating. If the resin paint is a thermosetting resin paint, the coated paint can be baked according to need. In view of the corrosion resistance and processability, it is preferred that the thickness (dry state) of the protective coating be 2 to 30 μm, especially 3 to 20 μm. In order to improve the draw-redrawability, a lubricant can be included in the coating.

As the thermoplastic resin film to be used for the lamination, there can be mentioned olefin resin films such as a polyethylene film, a polypropylene film, an ethylene/propylene copolymer film, an ethylene/vinyl acetate copolymer film, an ethylene/acrylic ester copolymer film and an ionomer film, polyester films such as a polyethylene terephthalate film, a polybutylene terephthalate film and an ethylene terephthalate/isophthalate copolymer film, polyamide films such as a nylon 6 film, a nylon 6,6 film, a nylon 11 film and a nylon 12 film, polyvinyl chloride films, and polyvinylidene chloride films. Either undrawn films or biaxially drawn films can be used. It is preferred that the thickness of the film be 3 to 50 μm, especially 5 to 40 μm. The lamination of the film to the metal sheet is accomplished by the fusion bonding method, the dry lamination method or the extrusion coating method. If the adhesion (heat fusion bondability) between the film and metal sheet is poor, for example, a urethane type adhesive, an epoxy type adhesive, an acid-modified olefin resin type adhesive, a copolyamide type adhesive or a copolyester type adhesive can be interposed.

In order to hide the metal sheet and assists the transmission of the blank holder force to the metal sheet at the drawing-redrawing forming, an inorganic filler (pigment) can be incorporated into the coating or film used in the present invention.

As the inorganic filler, there can be mentioned inorganic white pigments such as rutile type titanium dioxide, anatase type titanium dioxide, zinc flower and gloss white, white extender pigments such as barite, precipitated barite sulfate, calcium carbonate, gypsum, precipitated silica, aerosil, talc, calcined clay, uncalcined clay, barium carbonate, alumina white, synthetic mica, natural mica, synthetic calcium silicate and magnesium carbonate, black pigments such as carbon black and magnetite, red pigments such as red iron oxide, yellow pigments such as sienna, and blue pigments such as ultramarine and cobalt blue. The inorganic filler can be incorporated in an amount of 10 to 500% by weight, especially 10 to 300% by weight, based on the resin.

Figure 4:
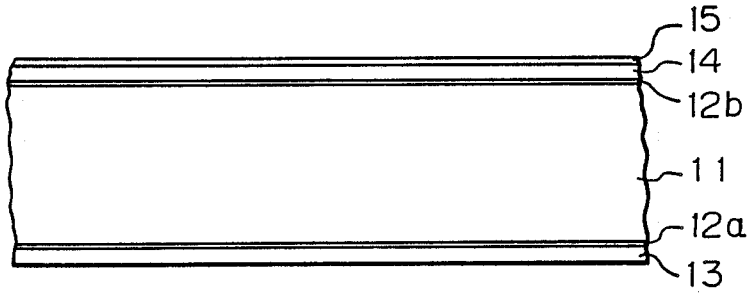
FIG. 4 is a sectional view illustrating an example of the covered metal sheet preferably used in the present invention.

FIG. 4 shows an example of the covered metal sheet preferably used in the present invention. Chemical conversion coatings **12*a* and 12*b* such as phosphate treatment coatings are formed on both the surfaces of the metal substrate 11, and an inner coating 13 is formed on the surface, to be formed into the inner surface of the can, through the chemical conversion coating 12*a*. An outer coating comprising a white coating 14 and a transparent varnish 15 is formed on the surface, to be formed into the outer surface of the can, through the chemical conversion coating 12*b***.

Figure 5:
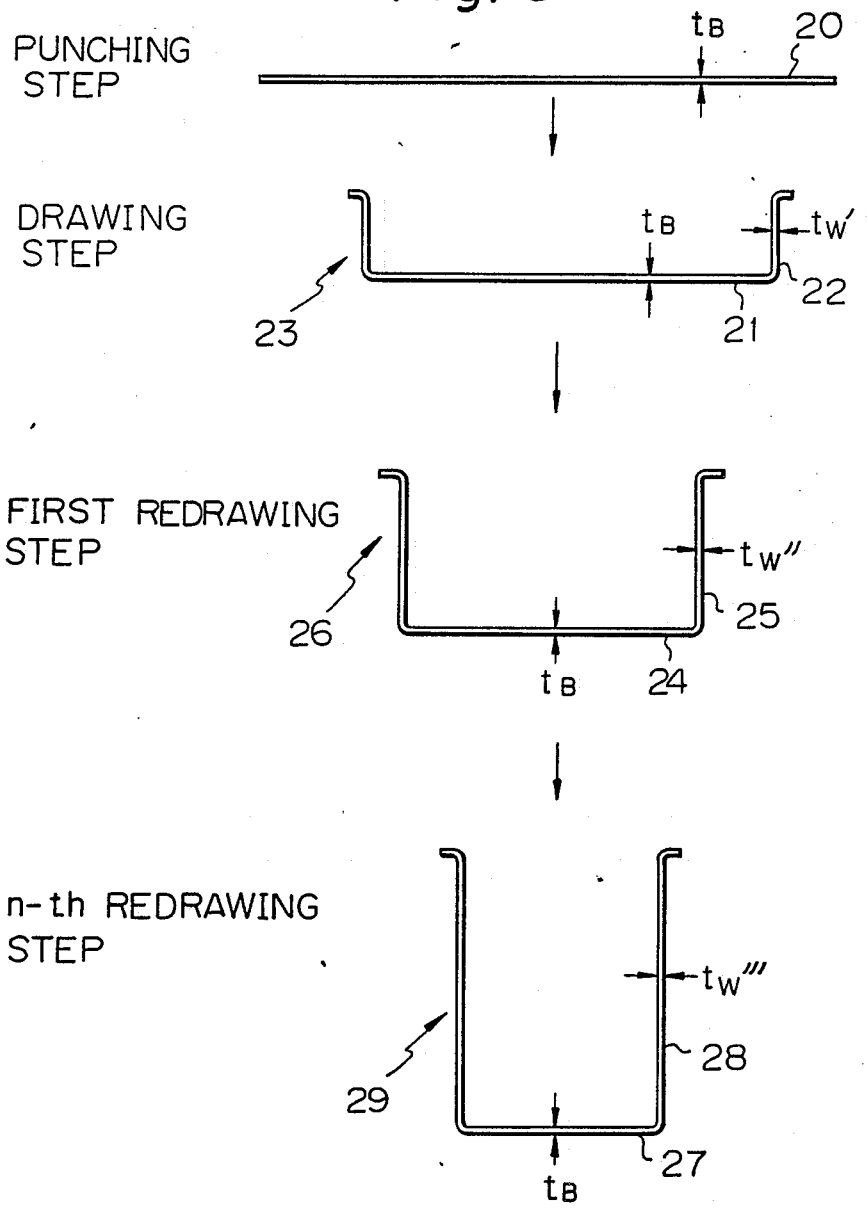
FIG. 5 is a sectional view illustrating the forming process of the present invention.

Referring to FIG. 5 illustrating the forming method of the present invention, the above-mentioned covered metal sheet is punched into a disk 20 having a thickness $t_B$ at the punching step. Then, at the drawing step, the disk 20 is draw-formed into a shallow-drawn cup 23 provided with a large-diameter bottom having a thickness $T_B$ and a low-height side wall having a thickness $T_W'$. It is preferred that the draw ratio [see formula (8)] at this drawing step be 1.2 to 1.9, especially 1.3 to 1.8. The thickness $T_W'$ of the side wall 22 is slightly large than $T_B$.

Then, at the first redrawing step, the shallow-drawn cup 23 is redrawn by the apparatus shown in FIG. 1 to form a redrawn cup 26 provided with a bottom 24 having a thickness. $T_B$ and a diameter smaller than that of the shallow-drawn cup and a side wall 25 having a thickness $T_W''$ and being higher than the shallow-drawn cup. According to the above-mentioned principle, the side wall 25 of the redrawn cup 26 is in the bent and elongated, and the thickness $T_W''$ is smaller than $T_B$ and $T_W'$.

In general, this redrawing forming is carried out in a plurality of stages. By carrying out this redrawing in a plurality of stages, the thickness of the side wall portion is further reduced and the thickness is further uniformalized throughout the side wall portion. At the final n-th redrawing step, a deep-drawn can 29 provided with a small-diameter bottom 27 having a thickness $T_B$ and a large-height side wall 28 having a thickness $T_W'''$ is obtained. The characteristic values of this can are as described above.

At the drawing forming or redrawing forming, it is preferred that the covered metal sheet or cup be coated, prior to the forming, with a lubricant such as liquid paraffin, synthetic paraffin, edible oil, hydrogenated edible oil, palm oil, natural wax or polyethylene wax. The amount coated of the lubricant is changed according to the kind of the lubricant, but it is generally preferred that the amount coated of the lubricant be 0.1 to 10 mg/dm$^2$, especially 0.2 to 5mg/dm$^2$. The coating of the lubricant can be accomplished by spray-coating the lubricant in the molten state.

The draw forming can be carried out at room temperature, but it is generally preferred that the draw forming be carried out at a temperature of 20° to 95° C., especially 20° to 90° C.

The formed can is subjected to various processings such as flange trimming, doming, neck-in processing and flanging, whereby a can barrel for a two-piece canned product is formed.

As is apparent from the foregoing description, according to the present invention, by selecting a small value for the radius ($R_D$) of curvature of the corner portion of the redrawing die, selecting a large value for the radius ($R_H$) of curvature of the corner portion of the holding member, selecting the dynamic friction coefficients ($\mu$) of the holding member and redrawing die and the redraw ratio (b/a) within the specific ranges and combining these values integrally, reduction and uniformalization of the thickness of the side wall portion and deep-draw forming become possible. Especially, if redrawing forming is carried out in 1 to 4 stages, the thickness of the side wall portion becomes more uniform.

Furthermore, according to the present invention, by reducing the thickness of the side wall portion uniformly, the can volume per unit weight of the can blank is increased, and the basis weight can be reduced to save the amount of the metal blank. Accordingly, the cost can be reduced and the weight of the vessel can be reduced. Moreover, since it is possible to coat the metal sheet before the forming, spray-coating of the formed can barrel becomes unnecessary, with the result that the coating cost can be reduced and environmental pollution by the solvent of the paint can be avoided. Still further, since even the thickness of the upper portion of the side wall of the can barrel can be uniformly reduced without ironing, the damage of the covering can be moderated even in the upper portion of the side wall where interfacial corrosion (corrosion caused in the interface between the head space and the contained liquid), with the result that the corrosion resistance of the can barrel can be highly improved.

The present invention will now be described in detail with reference to the following examples that by no means limit the scope of the invention.

Example 1

A tin-free steel sheet having a bare thickness of 0.18 mm and a tempering degree of DR-9 was coated with an epoxy type paint, followed by baking and drying, to obtain a covered metal sheet having a protecting coating having a thickness of about 20 $\mu$m. The covered metal sheet was coated with palm oil and punched into a disk having a diameter of 187 mm, and a shallow-drawn cup was formed from this disk between a drawing punch and a drawing die according to customary procedures.

The draw ratio at this drawing step was 1.5, and in the obtained shallow-drawn cup, the thickness $T_W$ of the side wall portion was larger by about 20% than $T_B$.

Then, the redrawing forming was carried out at the first, second and third redrawing steps by using the apparatus shown in FIG. 1.

The forming conditions adopted at the first, second and third redrawing steps were as follows.

Redraw ratio at first step: 1.29
Redraw ratio at second step: 1.24
Redraw ratio at third step: 1.20
Radius ($R_D$) of curvature at operating corner portion of redrawing die: 0.41 mm
Radius ($R_H$) of curvature of holding corner portion: 1.0 mm
Blank holder load; 6000 kg
Dynamic friction coefficient ($\mu$): 0.09

The deep-drawn cup prepared by the above-mentioned redrawing forming had the following characteristics.

Cup diameter: 66 mm
Cup height: 140 mm
Thickness change ratio in side wall: −18%
$T_U/T_L$: 1.3

Then, the cup was subjected to doming, trimming, neck-in processing and flanging according to customary procedures, and the cup was degreased and washed to obtain a can barrel for a two-piece canned product.

In order to check the damage of the protecting covering of the final can barrel, the degree of the metal exposure was measured. It was found that the enamel rater value of the entire vessel was 0.5 mA, the enamel rater value of the upper portion of the side wall was 0.4 mA and the enamel rater value of the lower portion of the side wall was 0.1 mA.

The redrawn can was cold-filled with (A) cola, (B) beer or (C) synthetic carbonated drink and was double-seamed with a metal lid to effect sealing. The packed can was heat-sterilized under conditions shown in Table 1.

TABLE 1

| Packed Can | Apparatus | Temperature | Autogeneous Pressure |
|---|---|---|---|
| (A) | can warmer | 42° C. | 7.0 kg/cm$^2$ |
| (B) | pasturizer | 62° C. | 6.2 kg/cm$^2$ |
| (C) | can warmer | 42° C. | 8.0 kg/cm$^2$ |

These three packed vessels were stored at room temperature or 37° C. for a long time, and the corrosion of the inner surface was observed and evaluated. The obtained results are shown in Table 2. As is seen from Table 2, no problem arose, and especially, no interfacial corrosion was found.

TABLE 2

| Content | Period / Evaluation item | One month Corrosion | One month Leakage | Three months Corrosion | Three months Leakage | Six months Corrosion | Six months Leakage |
|---|---|---|---|---|---|---|---|
| Cola | | | 0/100 | | 0/100 | | 0/100 |
| Beer | | | 0/100 | | 0/100 | | 0/100 |
| Synthetic carbonated drink | | | 0/100 | | 0/100 | | 0/100 |

Note
: no corrosion found

Example 2

An Al-Mn type Al alloy sheet having a bare thickness of 0.26 mm was coated with an epoxy type paint, followed by baking and drying, to obtain a covered metal sheet having a protecting coating having a thickness of about 20 μm. The covered metal sheet was coated with palm oil and punched into a disk having a diameter of 187 mm, and a shallow-drawn cup was formed from this disk between a drawing punch and a drawing die according to customary procedures.

The draw ratio at this drawing step was 1.5, and in the obtained shallow-drawn cup, the thickness $T_W'$ of the side wall portion was larger by about 25% than $T_B$.

Then, the redrawing forming was carried out at the first, second and third redrawing steps by using the apparatus shown in FIG. 1.

The forming conditions adopted at the first, second and third redrawing steps were as follows.

Redraw ratio at first step: 1.29
Redraw ratio at second step: 1.24
Redraw ratio at third step: 1.20
Radius ($R_D$) of curvature at operating corner portion of redrawing die: 0.5 mm
Radius ($R_H$) of curvature of holding corner portion: 2.0 mm
Blank holder load: 2000 kg
Dynamic friction coefficient (μ): 0.09

The deep-drawn cup prepared by the above-mentioned redrawing forming had the following characteristics.

Cup diameter: 66 mm
Cup height: 140 mm
Thickness change ratio in side wall: −18%
$T_U/T_L$: 1.4

Then, the cup was subjected to doming, trimming, neck-in processing and flanging according to customary procedures, and the cup was degreased and washed to obtain a can barrel for a two-piece canned product.

In order to check the damage of the protecting covering of the final can barrel, the degree of the metal exposure was measured. It was found that the enamel rater value of the entire vessel was 0.8 mA, the enamel rater value of the upper portion of the side wall was 0.6 mA and the enamel rater value of the lower portion of the side wall was 0.2 mA.

The redrawn can was cold-filled with (A) cola, (B) beer or (C) synthetic carbonated drink and was double-seamed with a metal lid to effect sealing. The packed can was heat-sterilized under conditions shown in Table 1.

These three packed vessels were stored at room temperature or 37° C. for a long time, and the corrosion of the inner surface was observed and evaluated. The obtained results are shown in Table 3. As is seen from Table 3, no problem arose, and especially, no interfacial corrosion was found.

TABLE 3

| Content | Period / Evaluation item | One month Corrosion | One month Leakage | Three months Corrosion | Three months Leakage | Six months Corrosion | Six months Leakage |
|---|---|---|---|---|---|---|---|
| Cola | | | 0/100 | | 0/100 | | 0/100 |
| Beer | | | 0/100 | | 0/100 | | 0/100 |
| Synthetic carbonated drink | | | 0/100 | | 0/100 | | 0/100 |

Note
: no corrosion found

Example 3

A tin-free steel sheet having a bare thickness of 0.18 mm and a tempering degree of DR-9 was coated with an epoxy type paint, followed by baking and drying, to obtain a covered metal sheet having a protecting coating having a thickness of about 20 μm. The covered metal sheet was coated with palm oil and punched into a disk having a diameter of 111 mm, and a shallow-drawn cup was formed from this disk between a drawing punch and a drawing die according to customary procedures.

The draw ratio at this drawing step was 1.5, and in the obtained shallow-drawn cup, the thickness $T_W'$ of the side wall portion was larger by about 22% than $T_B$.

Then, the redrawing forming was carried out at the redrawing step by using the apparatus shown in FIG. 1.

The forming conditions adopted at the redrawing step were as follows.

Redraw ratio: 1.14
Radius ($R_D$) of curvature at operating corner portion of redrawing die: 0.3 mm
Radius ($R_H$) of curvature of holding corner portion: 1.0 mm
Blank holder load: 5000 kg
Dynamic friction coefficient (μ): 0.06

The deep-drawn cup prepared by the above-mentioned redrawing forming had the following characteristics.

Cup diameter: 65 mm
Cup height: 38 mm
Thickness change ratio in side wall: −17%
$T_U/T_L$: 1.2

Then, the cup was subjected to doming, trimming, neck-in processing and flanging according to customary procedures, and the cup was degreased and washed to obtain a can barrel for a two-piece canned product.

In order to check the damage of the protecting covering of the final can barrel, the degree of the metal exposure was measured. It was found that the enamel rater value of the entire vessel was 0.4 mA, the enamel rater value of the upper portion of the side wall was 0.3 mA and the enamel rater value of the lower portion of the side wall was 0.1 mA.

The redrawn can was cold-filled with tuna flake and was double-seamed with a metal lid to effect sealing. The packed can was heat-sterilized at 113° C. for 70 minutes in a retorting reactor.

The packed vessel was stored at room temperature or 37° C. for a long time, and the corrosion of the inner surface was observed and evaluated. The obtained results are shown in Table 4. As is seen from Table 4, no problem arose, and especially, no interfacial corrosion was found.

TABLE 4

| Content | Period / Evaluation item | One month Corrosion | One month Leakage | Three months Corrosion | Three months Leakage | Six months Corrosion | Six months Leakage |
|---|---|---|---|---|---|---|---|
| Tuna flake | | | 0/100 | | 0/100 | | 0/100 |

Note
: no corrosion found

Comparative Example 1

A tin-free steel sheet having a bare thickness of 0.18 mm and a tempering degree of DR-9 was coated with an epoxy type paint, followed by baking and drying, to obtain a covered metal sheet having a protecting coating having a thickness of about 20 μm. The covered metal sheet was coated with palm oil and punched into a disk having a diameter of 187 mm, and a shallow-drawn cup was formed from this disk between a drawing punch and a drawing die according to customary procedures.

The draw ratio at this drawing step was 1.5, and in the obtained shallow-drawn cup, the thickness $T_W'$ of the side wall portion was larger by about 20% than $T_B$.

Then, the redrawing forming was carried out at the first, second and third redrawing steps by using he apparatus shown in FIG. 1.

The forming conditions adopted at the first, second and third redrawing steps were as follows.

Redraw ratio at first step: 1.29
Redraw ratio at second step: 1.24
Redraw ratio at third step: 1.20
Radius ($R_D$) of curvature at operating corner portion of redrawing die: 2 mm
Radius ($R_H$) of curvature of holding corner portion: 2 mm
Blank holder load: 4000 kg
Dynamic friction coefficient (μ): 0.09

The deep-drawn cup prepared by the above-mentioned redrawing forming had the following characteristics.

Cup diameter: 66 mm
Cup height: 105 mm
Thickness change ratio in side wall: +13%
$T_U/T_L$: 1.7

The height of the cup was lower than by 35 mm than the height of the cup obtained in Example 1. Accordingly, in order to form a vessel having the same volume as that of the vessel obtained in Example 1, the diameter of the disk of the blank sheet had to be increased. Namely, the diameter had to be increased to 214 mm, and the weight had to be increased by about 30% and the entire draw ratio had to be increased by about 14%.

In order to obtain the same inner volume as in Example 1, a blank sheet disk having a diameter of 214 mm was processed under the same conditions as described in Example 1.

The deep-drawn cup prepared by the above-mentioned redrawing forming had the following characteristics.

Cup diameter: 66 mm
Cup height: 140 mm
Thickness change ratio in side wall: +14%
$T_U/T_L$: 2.0

Then, the cup was subjected to doming, trimming, neck-in processing and flanging according to customary procedures, and the cup was degreased and washed to obtain a can barrel for a two-piece canned product.

In order to check the damage of the protecting covering of the final can barrel, the degree of the metal exposure was measured. It was found that the enamel rater value of the entire vessel was 15 mA, the enamel rater value of the upper portion of the side wall was 10 mA and the enamel rater value of the lower portion of the side wall was 5 mA. It was found that the protecting covering was drastically damaged in the upper portion of the side wall.

The redrawn can was cold-filled with (A) cola, (B) beer or (C) synthetic carbonated drink and was double-seamed with a metal lid to effect sealing. The packed can was heat-sterilized under conditions shown in Table 1.

These three packed vessels were stored at room temperature or 37° C. for a long time, and the corrosion of the inner surface was observed and evaluated. The obtained results are shown in Table 5. As is seen from Table 5, corrosion and leakage were caused in substantially all of the samples.

TABLE 5

| Content | Period / Evaluation item | One month Corrosion | One month Leakage | Three months Corrosion | Three months Leakage | Six months Corrosion | Six months Leakage |
|---|---|---|---|---|---|---|---|
| Cola | | local corrosion | 10/100 | conspicuous pitting | 42/100 | conspicuous pitting | 92/100 |
| Beer | | no corrosion | 0/100 | local corrosion | 3/100 | conspicuous pitting | 16/100 |
| Synthetic carbonated | | conspicuous pitting | 18/100 | conspicuous pitting | 62/100 | conspicuous pitting | 97/100 |

TABLE 5-continued

| Content | Period Evaluation item | One month Corrosion | One month Leakage | Three months Corrosion | Three months Leakage | Six months Corrosion | Six months Leakage |
|---|---|---|---|---|---|---|---|
| drink | | | | | | | |

Example 4

A can barrel was prepared in the same manner as described in Example 1 except that an aluminum-covered steel sheet (having a total thickness of 0.18 mm) having a press-welded aluminum layer having a thickness of 20 μm was used as the metal sheet and the forming was carried out so that the aluminum layer was formed into the inner surface of the can.

In order to check the damage of the protecting covering of the final can barrel, the degree of the metal exposure was measured. It was found that the enamel rater value of the entire vessel was 0.3 mA, the enamel rater value of the upper portion of the side wall was 0.2 mA and the enamel rater value of the lower portion of the side wall was 0.1 mA.

The redrawn can was cold-filled with (A) cola, (B) beer or (C) synthetic carbonated drink and was double-seamed with a metal lid to effect sealing. The packed can was heat-sterilized under conditions shown in Table 1.

These three packed vessels were stored at room temperature or 37° C. for a long time, and the corrosion of the inner surface was observed and evaluated. No problem arose, and especially, no interfacial corrosion was found.

I claim:

1. A redrawing method for forming a deep-drawn cup from a shallow-drawn cup previously drawn from a covered metal sheet wherein the redraw ratio, defined by the ratio of the diameter of the shallow-drawn cup to the diameter of the deep-drawn cup, is in the range of from 1.1 to 1.5;

placing the shallow-drawn cup in a redrawing die having an operating corner part having a radius ($R_D$) of curvature which is 1 to 2.9 times as large as the bare sheet thickness ($t_B$) of the metal sheet;

inserting an annular holding member in the shallow-drawn cup with the holding member having a holding corner part with a radius ($R_H$) of curvature 4.1 to 12 times as large as the bare sheet thickness ($t_B$) of the metal sheet;

applying a clamping force between flat engaging portions of the holding member and the redrawing die and the shallow-drawn cup to provide a dynamic friction coefficient of 0.001 to 0.2; and moving a redrawing punch and said redrawing die relative to each other to move the redrawing punch through the holding member into contact with the shallow-drawn cup and forming a deep-drawn cup having a diameter smaller than that of the shallow-drawn cup;

wherein said forming step comprises at least one stage including bending and elongating the entire side wall portion of the cup uniformally in the direction of the height of the cup by the operating corner part of the redrawing die thereby providing a uniformly reduced thickness for the entire side wall portion throughout the length thereof.

2. A redrawing method according to claim 5, wherein the redraw forming is carried out in a plurality of stages.

3. A redrawing method according to claim 5, wherein the redraw forming is carried out so that the draw ratio defined by the following formula:

*Draw ratio=(diameter of bare sheet)/(diameter of deep-drawn can)* is in the range of from 2.0 to 4.0 in the deep-drawn can as a whole.

4. A redrawing method according to claim 1, wherein the covered metal sheet comprises a substrate of a surface-treated steel sheet and a protecting covering layer of a thermosetting resin or a thermoplastic resin having a thickness of 2 to 30 μm.

5. A redrawing method according to claim 4, wherein the substrate of the surface-treated steel sheet is an electrolytically chromate-treated steel sheet having 10 to 200 mg/m2 of a metallic chromium layer and 1 to 50 mg/m2 of a chromium oxide layer.

6. A redrawing method according to claim 4, wherein the substrate of the surface-treated steel sheet is a tinplate sheet which has been subjected to a chromate/-phosphate treatment and has a deposited tin amount of 0.5 to 11.2 g/m$^2$ of a metallic chromium layer and 1 to 50 mg/m2 of a chromium oxide layer.

7. A redrawing method according to claim 4, wherein he bare thickness ($t_B$) of the surface-treated steel sheet is 0.10 to 0.30 mm.

8. A redrawing method according to claim 1, wherein the covered metal sheet comprises a substrate of an aluminum or aluminum alloy sheet and a protecting covering layer of a thermoplastic resin or a thermosetting resin having a thickness of 2 to 30 μm.

9. A redrawing method according to claim 8, wherein the aluminum allow comprises 0.2 to 1.5% by weight of Mn, 0.8 to 5% by weight of Mg, 0.25 to 0.3% by weight of Zn and 0.15 to 0.25% by weight of Cu, with the balance being Al.

10. A redrawing method according to claim 8, wherein the bare thickness ($t_B$) of the aluminum or aluminum allow sheet is 0.15 to 0.40 mm.

11. A redrawing method according to claim 1, wherein the radius ($R_D$) of the curvature at an operating corner part of the redrawing die is 1.5 to 2.9 times as large as the bare sheet thickness ($t_B$) of the metal sheet, the radius ($R_H$) of curvature of the holding corner part of the holding member is 4.1 to 11 times as large as the bare sheet thickness ($t_B$) of the metal sheet, flat engaging portions of the holding member and redrawing die with the preliminarily drawn cup have a dynamic friction coefficient of 0.001 to 0.1, and redraw forming is carried out in at least one stage so that the redraw ratio defined as the ratio of the diameter of the shallow-drawn cup to the diameter of the deep-drawn cup is in the range of from 1.15 to 1.45.

12. A redrawing method according to claim 1, wherein the entire draw ratio is in the range of from 2.0 to 4.0, the side wall portion is thinned to a thickness corresponding to 60 to 95% of the bare sheet thickness on the average, the ratio of the thickness of the upper portion of the side wall to the thickness of the lower portion of the side wall is less than 1.5, and the drawn-redrawn can has such a covering completeness that the enamel rater value (mA) of the upper portion of the side wall is smaller than 5 times the enamel rater value (mA) of the lower portion of the side wall.

13. A method for manufacturing a drawn-redrawn can, which comprises (i) punching a covered metal sheet comprising a substrate of a surface-treated steel sheet or an aluminum or aluminum alloy sheet into a disk having a bare thickness ($T_B$) of 0.1 to 0.5 mm, (ii) draw-forming the disk into a shallow-drawn cup provided with a large-diameter bottom and a low-height side wall at a draw ratio of 1.2 to 1.9, (iii) inserting an annular holding member and a redrawing punch arranged coaxially with the holding member and being capable of going into the holding member and coming out from the holding member, (iv) holding the shallow-drawn cup by the annular holding member and a redrawing die arranged coaxially with the annular holding member and the redrawing punch, said redrawing die having an operating corner part, at which the radius ($R_D$) of curvature is 1 to 2.9 times as large as the bare thickness ($t_B$) of the sheet, said annular holding member having a holding corner part at which the radius ($R_H$) of curvature is 4.1 to 12 times as large as the bare thickness ($t_B$) of the sheet, each of the annular holding member and the redrawing die having a flat engaging portion with the shallow-drawn cup and said flat engaging portions having a dynamic friction coefficient of 0.001 to 0.2 with said shallow-drawn cup, and (v) relatively moving the redrawing die and the redrawing punch, so that the redrawing die and the redrawing punch are engaged with the shallow-drawn cup to redraw the shallow-drawn cup into a deep-drawn cup so that the entire side wall portion of the cup is bent and elongated substantially vertically to the axial direction by the operating corner part of the redrawing die and that the redraw ratio defined as the ratio of the diameter of the shallow-drawn cup to the diameter of the deep-drawn cup is in the range of from 1.1 to 1.5.

14. A method according to claim 13, wherein said steps (iii) to (v) are carried out in a plurality of stages.

* * * * *